United States Patent [19]

Destro

[11] Patent Number: 4,733,675

[45] Date of Patent: Mar. 29, 1988

[54] MESSAGE TRANSMITTING ASHTRAY

[76] Inventor: Charles Destro, 6 Poplar St., Massapequa, N.Y. 11758

[21] Appl. No.: 838,802

[22] Filed: Mar. 12, 1986

[51] Int. Cl.[4] ..... A24F 19/10

[52] U.S. Cl. ..... 131/270; 131/231; 131/238; 340/328; 340/622

[58] Field of Search ..... 131/270, 231, 238; 252/462; 116/214; 340/328, 622; 224/278

[56] References Cited

U.S. PATENT DOCUMENTS 4,119,419 10/1978 Passaro et al. ..... 131/238

4,595,905 6/1986 May ..... 131/238

*Primary Examiner*—V. Millin

*Attorney, Agent, or Firm*—Richard L. Miller

[57] ABSTRACT

A message transmitting ashtray is provided and consists of an ashtray disposed in a base containing a message transmitting mechanism which is responsive to a cigarette coacting with an activation mechanism in the ash tray.

5 Claims, 4 Drawing Figures

MESSAGE TRANSMITTING ASHTRAY

BACKGROND OF THE INVENTION

This invention relates to an ashtray; and more particularly to a message transmitting ashtray.

The desire to stop smoking among smokers is well known. It appears that much of the habit is psychological. While methods seem to exist which deal with the physical aspects, nothing seems to exists which acts as a constant reminder to the smoker of the adverse effects of smoking.

SUMMARY OF THE INVENTION

It is therefore an object of this invention to provide a new and improved ashtray.

It is another object of this invention to provide a new and improved ashtray which provides a visual message.

It is yet another object of this invention to provide a new and improved ashtray which is activated mechanically.

It is still another object of this invention to provide a new and improved ashtray which is activated by a switch or heat sensor.

It is a further object of this invention to provide a new and improved ashtray which provides an audible message.

It is still a further object of this invention to provide a new and improved ashtray which provides an electromechanical message.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
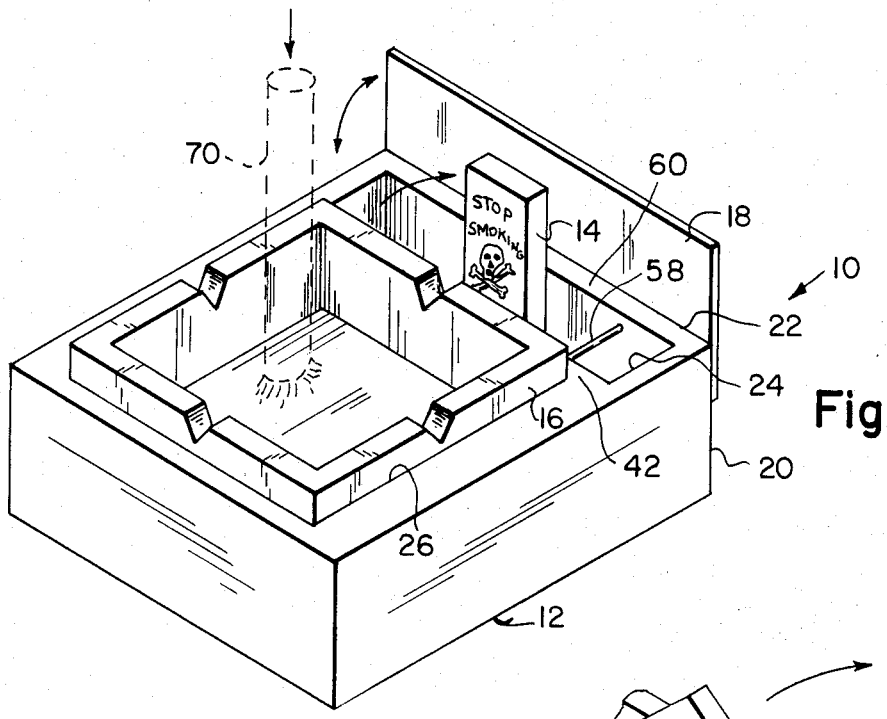
FIG. 1 is a perspective view of the invention.
Figure 2:
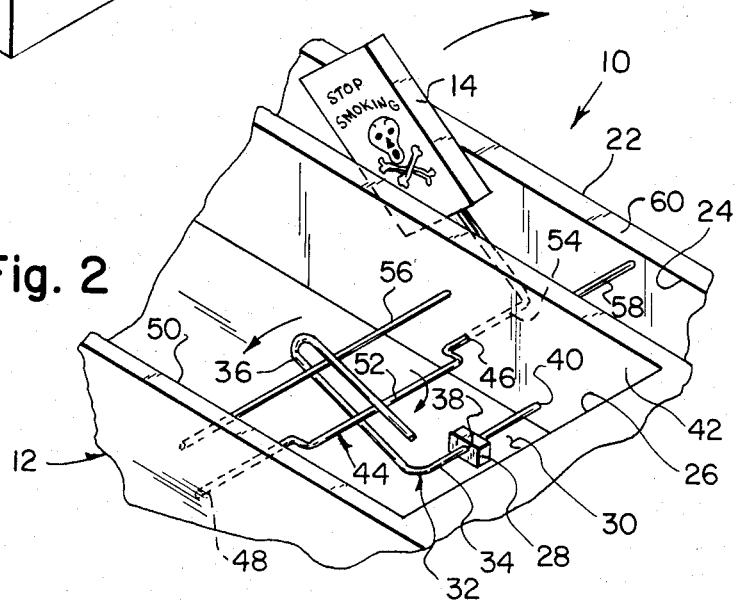
FIG. 2 is a partial perspective view with the ashtray removed to show the internal construction therein.

With reference to FIG. 1 there is generally shown a message transmitting ashtray 10. A base 12 contains a visual display 14 and an ashtray 16. A lid 18 is disposed on a surface 20 of base 12. Lid 18 is a hinged member which rotates around an edge 22. Lid 18 is of a rectangular form of predetermined size sufficient to cover a first cavity 24 which is disposed in base 12 proximate surface 20. Cavity 24 is of a predetermined size so as to encase display 14. A second cavity 26 (FIG. 2) disposed in base 12 is of a predetermined size to accommodate ashtray 16. A mounting block 28 is affixed to a bottom surface 30 of cavity 26. An actuating lever 32 in the form of an L-shape having a first leg 34 and a second leg 36 wherein leg 36 is U-shaped and leg 34 is rotatively mounted through a hole 38 disposed in block 28 and a hole 40 disposed in a wall 42 of cavity 26. Hole 38 and hole 40 are of a predetermined size to allow leg 34 to rotate freely therein. A crank 44 is mounted in hole 46 disposed in wall 42 and hole 48 disposed in a second wall 50. An eccentric portion 52 is longitudinally disposed on crank 44 essentially equidistant from walls 42 and 50. Extending through hole 46 in wall 42 is an L-shaped portion 54 which is affixed to visual display 14 by glueing, press fit or other conventional methods. A spring 56 is affixed to walls 42 and 50 parallel to bottom 30. A stop 58 is positioned proximate the top and one end of first cavity 24 and secured between wall 42 and a wall 60.

Ashtray 16 and base 12 may be made of plastic, ceramic or like material. Crank 44, lever 32, spring 56 and stop 58 are constructed of steel rod or the like.

METHOD OF OPERATION

When a cigarette 70 is pushed into ashtray 16 so as to extinquish cigarette 70 a bottom surface (not shown) of ashtray 16 coacts with portion 36 of lever 32 rotating in such a manner as to coact lever 32 and with eccentric 52 of crank 44 which rotates visual display 14 to a vertical position. Rotation of visual display 14 lifts lid 18.

Figure 3:
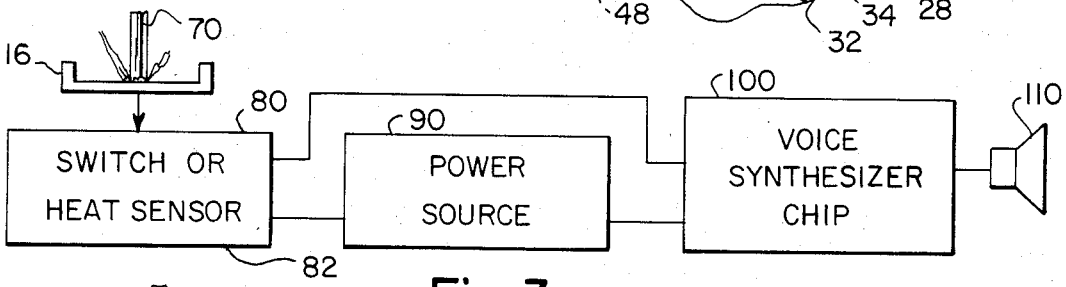
FIG. 3 is a block diagram of a modification using a voice synthesizer chip.
Figure 4:
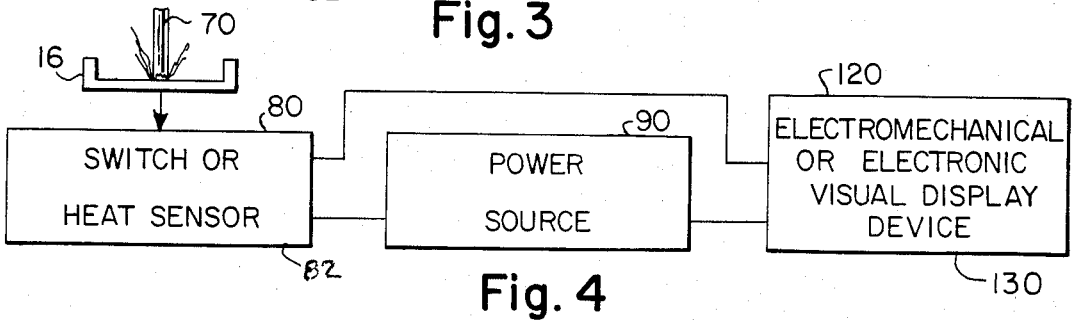
FIG. 4 is a block diagram of still another modification using an electromechanical or an electronic visual display device.

FIGS. 3 and 4 show alternative activating and display modes diagrammatically. Instead of the mechanical sequence described an electrical contact is made when cigarette is extinquished. A switch 80 is electrically connected to a power supply 90; a voice synthesizer chip 100, and a speaker 110 in a circuit which will produce an audible message. Alternatively the switch 80 may be a heat sensor 82 activated by the heat of a burning cigarette 70. Another alternative would be the activation of an electromechanical display 120 or electronic visual display 130, typical but not limited to such components as Light Emitting Diodes, or Liquid Crystal Diodes.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. The message transmitting ashtray comprising:

(a) a base;

(b) an ashtray carried by said base;

(c) means for activating message transmission carried by said base, which coacts with said ashtray; and (d) a display which coacts with said means for activating, whereby a message is transmitted and wherein said means for activating is a heat sensor.

2. The message transmitting ashtray of claim 1, wherein the display is audible.

3. The message transmitting ashtray of claim 1, wherein the display is electromechanical.

4. The message transmitting ashtray of claim 1, wherein the display is an electronic visual display device.

5. The message transmitting ashtray comprising:

(a) a base;

(b) an ashtray carried by said base;

(c) means for activating message transmission carried by said base, which coacts with said ashtray; and (d) a display which coacts with said means for activating, whereby a message is transmitted and wherein said means for activating comprises:

(i) a lever carried by said base which coacts with said ashtray;

(ii) a crank having an eccentric portion which coacts with said lever, disposed in said base; and (iii) a spring carried by said base which coacts with said lever, wherein said display is affixed to said crank.

* * * * *